US008068061B2

(12) United States Patent
Qi et al.

(10) Patent No.: US 8,068,061 B2
(45) **Date of Patent: *Nov. 29, 2011**

(54) MOBILE WIRELESS COMMUNICATIONS DEVICE INCLUDING AN ELECTRICALLY CONDUCTIVE, ELECTRICALLY FLOATING ELEMENT AND RELATED METHODS

(75) Inventors: Yihong Qi, St. Agatha (CA); Ying Tong Man, Waterloo (CA); Krystyna Bandurska, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/901,633

(22) Filed: Oct. 11, 2010

(65) Prior Publication Data

US 2011/0028192 A1 Feb. 3, 2011

Related U.S. Application Data

(63) Continuation of application No. 11/467,955, filed on Aug. 29, 2006, now Pat. No. 7,812,770.

(51) Int. Cl.
*H01Q 1/24* (2006.01)
*H01Q 1/42* (2006.01)

(52) U.S. Cl. ..... 343/702; 343/817; 343/818; 343/833; 343/872; 343/700 MS

(58) Field of Classification Search ..... None
See application file for complete search history.

(56) References Cited

U.S. PATENT DOCUMENTS

| | | | | |
|---|---|---|---|---|
| 5,946,395 | A | 8/1999 | Petrella et al. | 379/433.01 |
| 6,380,899 | B1 * | 4/2002 | Madsen et al. | 343/702 |
| 6,525,928 | B1 * | 2/2003 | Madsen et al. | 361/679.56 |
| 6,765,536 | B2 | 7/2004 | Phillips et al. | 343/702 |
| 6,856,819 | B2 | 2/2005 | Itoh | 455/575.7 |
| 6,904,296 | B2 * | 6/2005 | Geeraert et al. | 455/550.1 |
| 6,943,733 | B2 | 9/2005 | Vance | 343/700 |
| 6,980,173 | B2 | 12/2005 | Man et al. | 343/841 |
| 7,239,270 | B2 | 7/2007 | Qi et al. | 342/357.1 |
| 7,243,851 | B2 * | 7/2007 | Zhu et al. | 235/472.02 |
| 7,391,380 | B2 * | 6/2008 | Nevermann | 343/702 |
| 7,423,605 | B2 * | 9/2008 | Qi et al. | 343/818 |
| 7,812,770 | B2 * | 10/2010 | Qi et al. | 343/702 |
| 2001/0021643 | A1 | 9/2001 | Itoh | 455/90 |
| 2004/0032370 | A1 | 2/2004 | Ito et al. | 343/702 |
| 2005/0001769 | A1 | 1/2005 | Qi et al. | 343/700 MS |
| 2005/0017906 | A1 | 1/2005 | Man et al. | 343/700 MS |
| 2006/0030377 | A1 * | 2/2006 | White et al. | 455/575.1 |
| 2006/0038736 | A1 | 2/2006 | Hui et al. | 343/835 |
| 2006/0092084 | A1 | 5/2006 | Sakurai | 343/702 |
| 2008/0316114 | A1 | 12/2008 | Qi et al. | 343/702 |
| 2010/0033383 | A1 * | 2/2010 | Yamamoto | 343/702 |

(Continued)

FOREIGN PATENT DOCUMENTS

| | | | |
|---|---|---|---|
| CN | 1297593 | A | 5/2001 |

(Continued)

*Primary Examiner* — Trinh Dinh

(74) *Attorney, Agent, or Firm* — Allen, Dyer, Doppelt, Milbrath & Gilchrist, P.A.

(57) ABSTRACT

A mobile wireless communications device may include a portable housing having an interior and comprising a removable panel providing access to the interior, a printed circuit board (PCB) carried by the portable housing. The device may further include an antenna connected to the PCB and carried by the bottom portion of the PCB, and at least one electrically floating, electrically conductive, antenna beam shaping element secured to the removable panel.

31 Claims, 4 Drawing Sheets

U.S. PATENT DOCUMENTS

2011/0025567 A1* 2/2011 Qi et al. ..... 343/702

FOREIGN PATENT DOCUMENTS

| | | |
|---|---|---|
| DE | 20114640 | 12/2001 |
| EP | 1359639 | 11/2003 |
| EP | 1622607 | 5/2006 |
| JP | 2001077611 | 3/2001 |
| WO | 02/071534 | 9/2002 |
| WO | 2004/021511 | 3/2004 |
| WO | 2005/004277 | 1/2005 |

* cited by examiner

MOBILE WIRELESS COMMUNICATIONS DEVICE INCLUDING AN ELECTRICALLY CONDUCTIVE, ELECTRICALLY FLOATING ELEMENT AND RELATED METHODS

RELATED APPLICATION

This application is a continuation of Ser. No. 11/467,955 filed Aug. 29, 2006, now U.S. Pat. No. 7,812,770 issued Oct. 12, 2010, the entire disclosure of which is hereby incorporated herein by reference.

FIELD OF THE INVENTION

The present invention relates to the field of communications devices, and, more particularly, to mobile wireless communications devices and related methods.

BACKGROUND

Cellular communications systems continue to grow in popularity and have become an integral part of both personal and business communications. Cellular telephones allow users to place and receive voice calls most anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for the antenna.

One approach for reducing phone size is to use flip phones having top and bottom housings connected with a hinge. The housings may be closed when the phone is not in use so that it is more compact and easier for a user to carry. One exemplary antenna system for a flip style cellular phone is described in U.S. Pat. No. 6,765,536. In particular, the antenna system includes an external antenna element carried on the top of the lower housing, and a parasitic element carried by the top housing so that when the phone is flipped open the parasitic element is in close proximity to the antenna element. A tuning circuit carried by the lower housing is electrically coupled to the parasitic element. The tuning circuit is variable to adjust the parasitic load on the antenna element to provide variable operating frequencies and bandwidths for the phone.

External cell phone antennas are advantageous in that they are spaced apart from the user's head, which makes it easier for phone manufacturers to comply with applicable specific absorption rate (SAR) requirements, for example. This is because the farther the radiating element of the cell phone antenna system is from the user, the less intense the radiation exposure to the user. Yet, many users prefer internal antennas over external antennas, as external antennas are prone to catch on objects and become damaged, for example. Yet, with the ever increasing trend towards smaller cell phone sizes, for a relatively small phone having an internal antenna, this may place the antenna in relatively close proximity to the user's ear, which may make complying with applicable SAR and/or hearing aid compatibility (HAC) requirements potentially difficult for manufacturers.

DETAILED DESCRIPTION OF THE PREFERRED EMBODIMENTS

Figure 1:
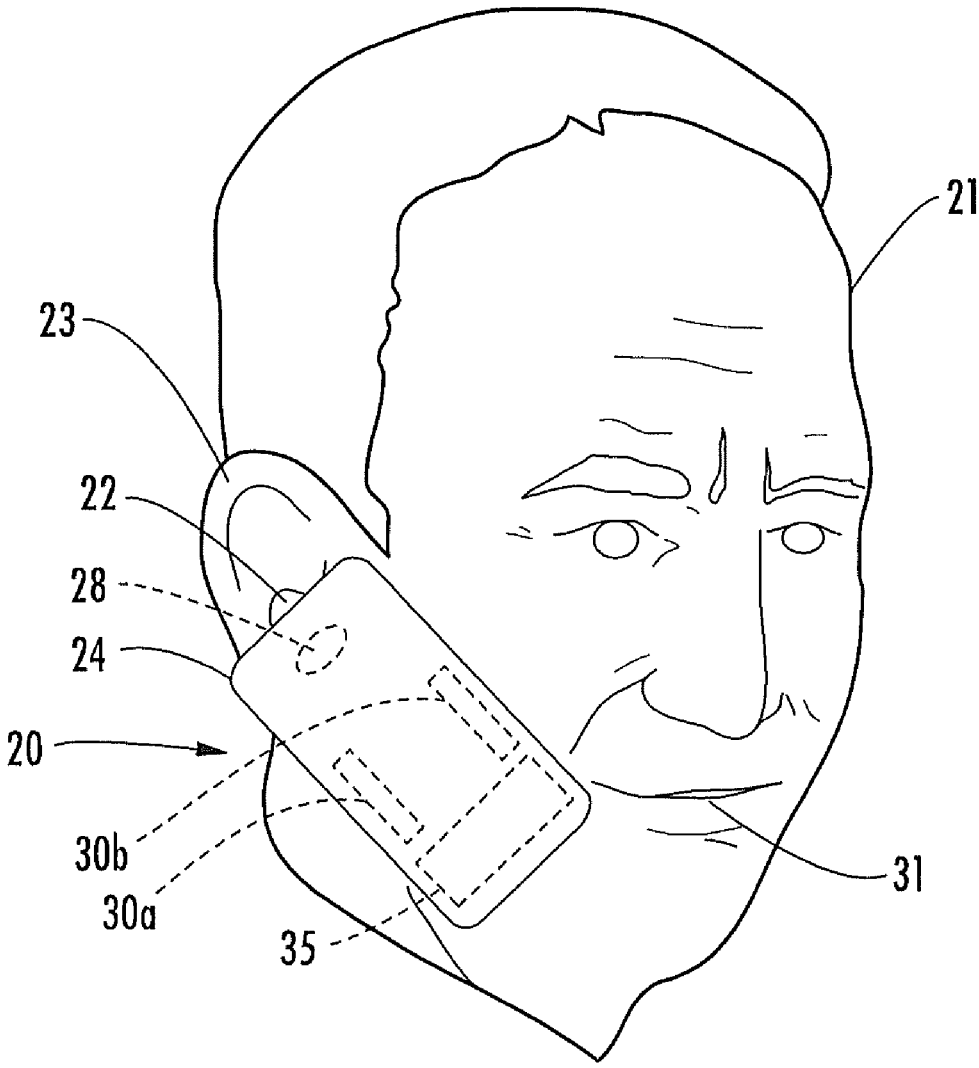
FIG. 1 is a perspective view of a mobile wireless communications device in accordance with one exemplary embodiment next to a user wearing an electronic hearing aid.
Figure 2:
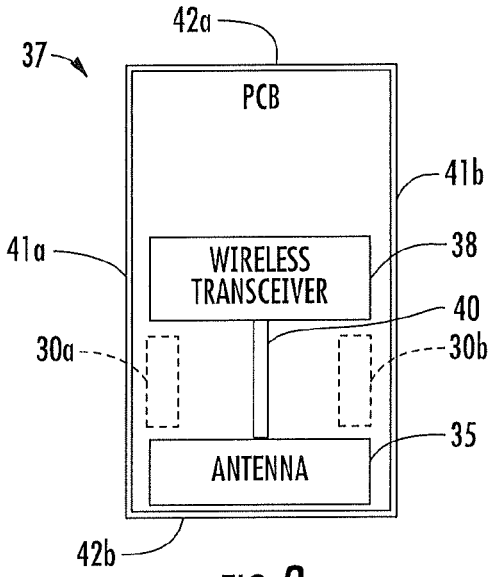
FIG. 2 is a schematic front view of the PCB and electrically floating, electrically conductive antenna beam shaping elements of the mobile wireless communications device of FIG. 1.

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements in alternative embodiments.

Generally speaking, a mobile wireless communications device is disclosed herein which may include a portable housing having a surface, a printed circuit board (PCB) carried by the portable housing, and wireless transceiver circuitry carried by the PCB. Moreover, the device may further include an antenna connected to the transceiver, and at least one electrically floating, electrically conductive, antenna beam shaping element secured to the surface of the portable housing for directing a beam pattern of the antenna.

More particularly, the device may further include an adhesive layer for adhesively securing the at least one beam shaping element to the surface of the portable housing. In addition, the at least one beam shaping element may include at least one generally rectangular metal layer. Also, the surface of the portable housing may have a color, and the device may further include a cover layer over the metal layer having the color of the portable housing.

The PCB may have a top portion and a bottom portion, and the antenna may be carried by the bottom portion of the PCB, for example. Additionally, the device may further include a battery carried within the portable housing and connected to the PCB, and the portable housing may include a removable access panel for accessing the battery. As such, the at least one beam shaping element may be secured to a surface of the removable access panel.

The surface of the portable housing may be an interior surface and/or an exterior surface. Moreover, the at least one beam shaping element may comprise a plurality thereof. Furthermore, the at least one beam shaping element and the antenna need not be vertically overlapping. The at least one beam shaping element may be positioned substantially parallel to a longitudinal axis of the portable housing, for example. Also by way of example, the wireless transceiver may be a cellular transceiver.

Referring initially to FIGS. 1 through 5, a mobile wireless communications device, such as a cellular telephone 20, is for a user 21. In some applications, the user 21 may be wearing an electronic hearing aid 22 in an ear 23 of the user. In particular, the cellular telephone 20 may advantageously provide desired hearing aid compatibility (HAC) for users with hearing aids in some implementations, as will be discussed further below, but need not be used with hearing aids in all embodiments.

The cellular telephone 20 illustratively includes a portable housing 24 and an audio output transducer 28 (e.g., a speaker) carried by the housing and accessible to the electronic hearing aid 22 of the user 21 adjacent the top of the housing as shown. An audio input transducer (e.g., microphone) is also carried by the housing 24 and accessible to a mouth 31 of the user 21 adjacent the bottom of the housing. Although described herein with reference to a cellular device, it should be noted that the present disclosure may be applicable to other wireless communications devices such as wireless LAN devices, etc.

The cellular telephone 20 further illustratively includes a printed circuit board (PCB) 37 carried by the housing 24, and an antenna 35 and a wireless (e.g., cellular) transceiver 38 carried on a front surface of the PCB. Of course, these components may be carried on the back surface or in positions other than those shown in other embodiments. The PCB 37 further illustratively includes an antenna feed line 40 connecting the antenna 35 to the wireless transceiver 38. By way of example, the antenna 35 may be formed by a plurality of conductive traces on the PCB 37, for example, as will be appreciated by those skilled in the art. The cellular telephone 20 may further include other components connected to the PCB 37 such as a display, battery, keypad, processing circuitry, etc., as will be discussed further below.

The antenna 35 is positioned adjacent a bottom 42*b* of the PCB 37, and therefore the bottom of the housing 24, which advantageously helps reduce coupling to the electronic hearing aid 22 of the user 21 with respect to traditional top mounted, internal cellular phone antennas. This is because the electronic hearing aid 22 of the user 21 is advantageously further separated from the antenna 35 when the cellular telephone 20 is held adjacent the user's ear 23 than would otherwise be the case with a typical top mounted, internal cellular telephone antenna, for example. Moreover, this antenna placement also helps space the antenna 35 farther apart from the user's brain, which in turn helps to reduce the SAR of the cellular telephone 20 again with a respect to a traditional top mounted, internal cellular phone antenna.

Nonetheless, if the portable housing 24 has a relatively small form factor or footprint for user convenience, this means that the antenna 35 may still be positioned relatively close to the user's ear 23, thus potentially elevating the SAR or coupling to the hearing aid 22 to unacceptable levels. As such, the cellular telephone 20 may therefore advantageously include electrically floating, electrically conductive, antenna beam shaping elements 30*a*, 30*b* for helping to direct the beam pattern of the antenna 35 away from the user and the hearing aid 22, as will be appreciated by those skilled in the art.

Figure 3:
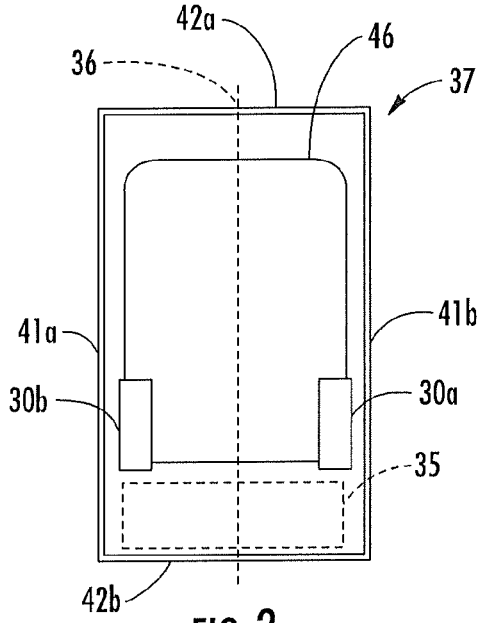
FIG. 3 is a schematic rear view of the PCB and electrically floating, electrically conductive antenna beam shaping elements of the mobile wireless communications device of FIG. 1.
Figure 4:
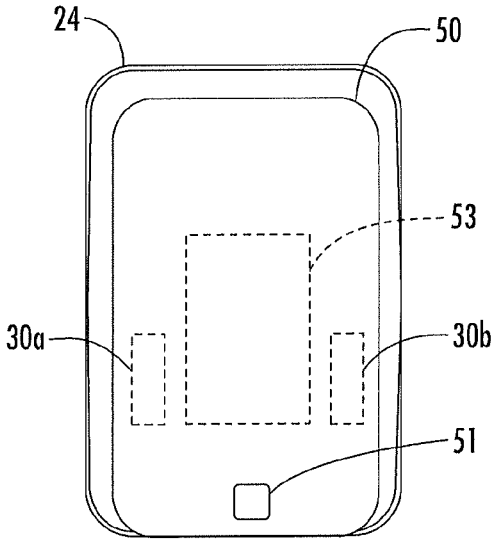
FIG. 4 is a schematic rear view of the portable housing and removable battery access panel of the mobile wireless communications device of FIG. 1.
Figure 5:
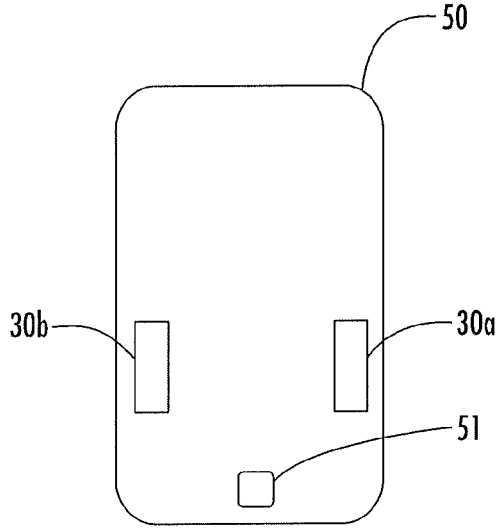
FIG. 5 is a schematic view of an inner surface of the removable battery access panel of FIG. 4 with the electrically floating, electrically conductive antenna beam shaping elements secured thereto.

In the present embodiment, a pair of beam shaping elements 30*a*, 30*b* are included although other numbers of beam shaping elements may be used, as will be discussed further below. The beam shaping elements 30*a*, 30*b* may be secured to an internal and/or an external surface of the portable housing 24. More particularly, as shown in FIGS. 4 and 5, the cellular telephone 20 illustratively includes a battery 53 carried within the portable housing 24 and connected to the PCB 37, and a removable access panel 50 provides access to the battery. As such, in the illustrated embodiment the beam shaping elements 30*a*, 30*b* are secured to the inner surface of the removable access panel (FIG. 5). It should be noted that the beam shaping elements 30*a*, 30*b* are shown overlying the PCB 37 in FIGS. 2 and 3 to illustrate their position relative to the antenna 35, but the beam shaping elements in the exemplary embodiment do not actually contact the PCB (i.e., they are carried by the housing 24 or removable battery access panel 50, which is spaced apart from the PCB).

In the exemplary embodiment, the beam shaping elements 30*a*, 30*b* are generally rectangular metal layers that are secured to the inner surface of the access panel 50 with an adhesive layer. However, the beam shaping elements 30*a*, 30*b* may take different shapes in different embodiments, and may be secured to the housing 24 and/or access panel 50 by suitable methods of attachment other than an adhesive. For example, the beam shaping elements 30*a*, 30*b* may be printed on the housing/access panel with conductive ink, similar to conductive traces on a circuit board.

Furthermore, the beam shaping elements 30*a*, 30*b* and the antenna 35 are preferably not vertically overlapping with one another so that antenna performance is not adversely affected. By way of example, the beam shaping elements 30*a*, 30*b* may be positioned substantially parallel to a longitudinal axis 36 of the portable housing, as shown in FIG. 3, although other placements may also be possible in different embodiments, as will be appreciated by those skilled in the art. Also by way of example, each beam shaping element 30*a*, 30*b* may have a width in a range of about 2 to 15 mm, and a length in a range of about 2 to 10 cm, although other sizes may also be used in some embodiments. As will be appreciated by those skilled in the art, the size, number, and placement of the beam shaping elements 30*a*, 30*b* will have an effect on the performance of the antenna 35. Thus, the particular size/number/placement selection may vary depending upon the given implementation and the applicable antenna performance characteristics.

Figure 6:
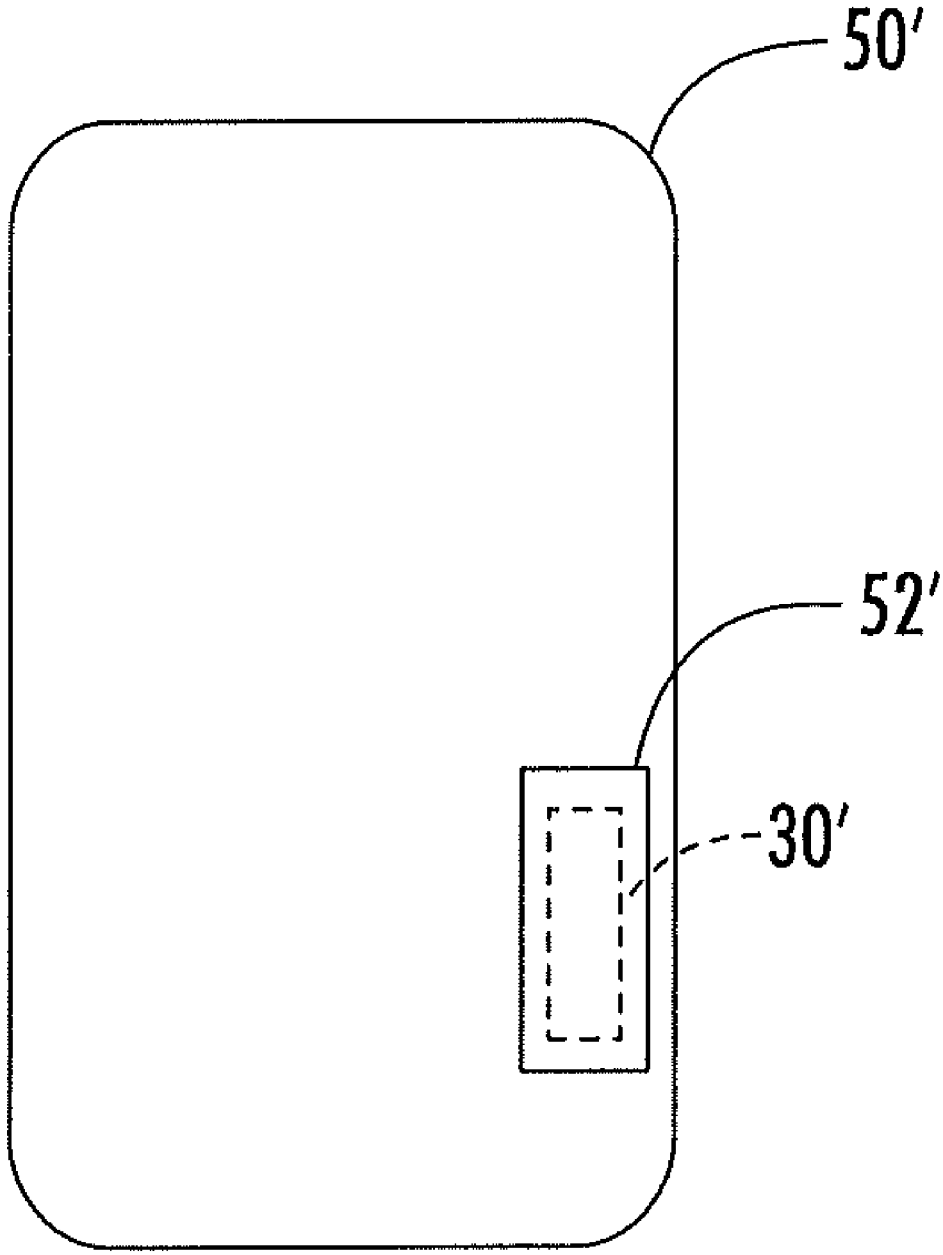
FIG. 6 is a schematic view of an alternative embodiment of the battery access panel of FIG. 5 with a single electrically floating, electrically conductive antenna beam shaping element secured thereto and with a cover layer thereon.

Referring now to FIG. 6, an alternative embodiment is shown in which a single beam shaping element 30' is used, rather than the pair of beam shaping elements 30*a*, 30*b* discussed above. Moreover, in this example a cover layer 52' is placed on the single beam shaping element 30'. The cover layer 52' may be a dielectric layer, such as a dielectric tape layer, for example. The cover layer 52' may advantageously help protect the beam shaping element 30' so that it not damaged or altered and SAR and/or HAC performance potentially degraded. Moreover, the cover layer 52' may also advantageously conceal the beam shaping elements 30', for example, by making the cover layer the same color as a color of the portable housing 30' and/or the access panel 50'.

The number of beam shaping elements 30 to be used in a given cellular telephone 20 will generally depend upon the performance and SAR/HAC requirements for the particular phone. More specifically, Applicants have found that in one exemplary implementation a single beam shaping element 30 was adequate to direct the antenna 35 beam away from the user enough to comply with applicable FCC SAR regulations. Applicants have also found that adding a second beam shaping element 30 in the same implementation provided additional beam shaping such that coupling with the hearing aid 22 was reduced sufficiently to also comply with applicable FCC HAC regulations. Additional beam shaping elements may also be appropriate in certain implementations, as will be appreciated by those skilled in the art.

A method aspect is for improving specific absorption rate (SAR) of a mobile wireless communications device 20 including a portable housing 24 having a surface, a PCB 37 carried by the portable housing, wireless transceiver circuitry 38 carried by the PCB, and an antenna 35 connected to the transceiver. The method may include securing one or more electrically floating, electrically conductive, antenna beam shaping elements 30*a*, 30*b* to the surface of the portable housing 24 for directing a beam pattern of the antenna 35 to advantageously reduce a rate of absorption of radio frequency (RF) energy from the mobile wireless communications device that is absorbed by a user 21.

Other exemplary components of a hand-held mobile wireless communications device 1000 are now described in the example below with reference to FIG. 7. The device 1000 illustratively includes a housing 1200, a keypad 1400 and an output device 1600. The output device shown is a display 1600, which is preferably a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user.

The housing 1200 may be elongated vertically, or may take on other sizes and shapes (including clamshell housing structures). The keypad may include a mode selection key, or other hardware or software for switching between text entry and telephony entry.

Figure 7:
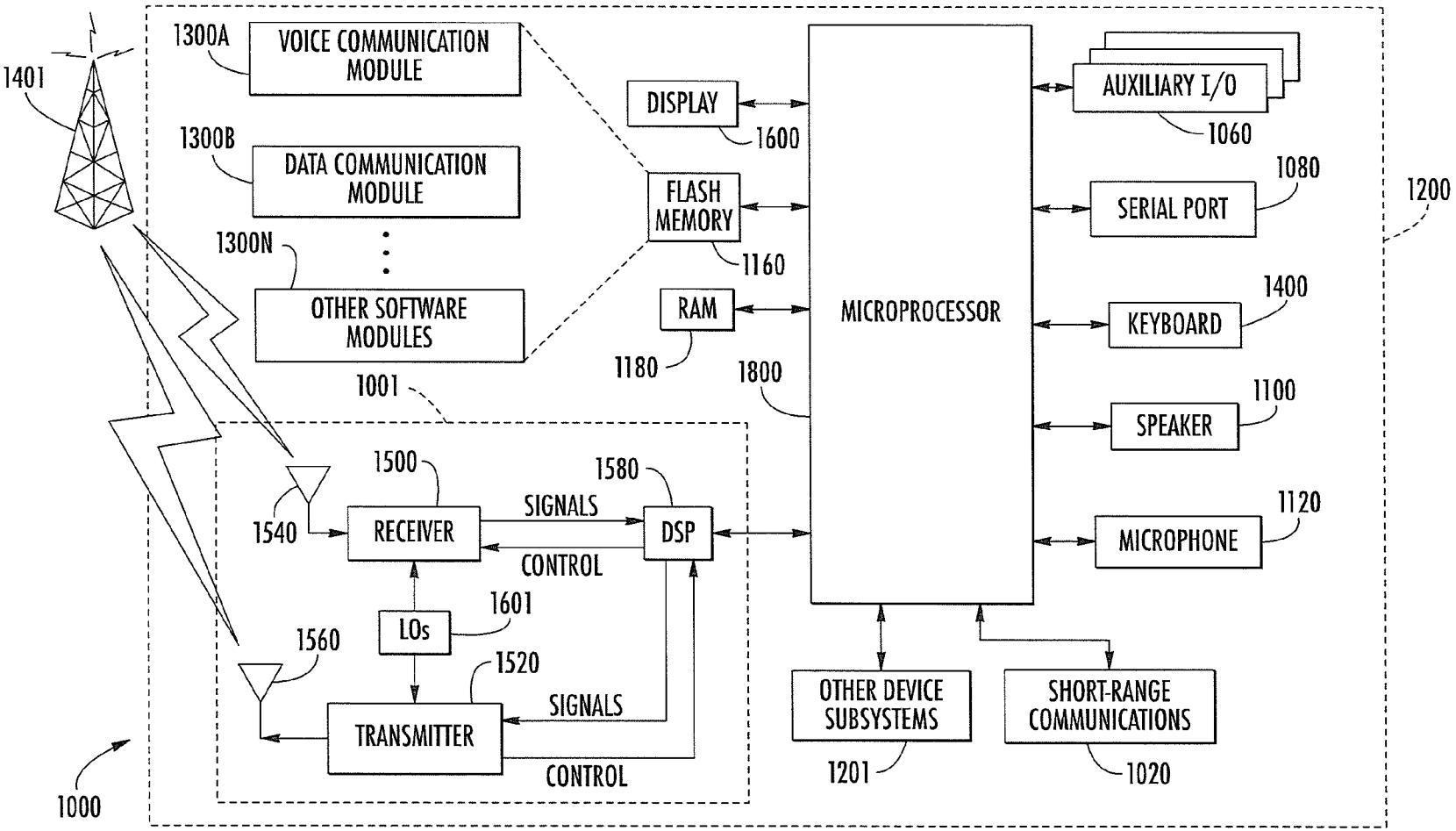
FIG. 7 is a schematic block diagram of the mobile wireless communications device of FIG. 1 illustrating additional exemplary components thereof.

In addition to the processing device 1800, other parts of the mobile device 1000 are shown schematically in FIG. 7. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 1401. Preferably, the PIM data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device

1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:

a housing having an interior and comprising a removable panel providing access to the interior;

a printed circuit board (PCB) carried by said housing and comprising a top portion and a bottom portion;

an antenna connected to said PCB and carried by the bottom portion of said PCB; and at least one electrically floating, electrically conductive, antenna beam shaping element secured to said removable panel.

2. The mobile wireless communications device of claim 1 further comprising an adhesive layer adhesively securing said at least one beam shaping element to said removable panel.

3. The mobile wireless communications device of claim 1 wherein said at least one beam shaping element comprises at least one generally rectangular metal layer.

4. The mobile wireless communications device of claim 1 further comprising a cover layer over said at least one beam shaping element.

5. The mobile wireless communications device of claim 1 wherein said removable panel comprises an exterior surface to which said at least one beam shaping element is secured.

6. The mobile wireless communications device of claim 1 wherein said removable panel comprises an interior surface to which said at least one beam shaping element is secured.

7. The mobile wireless communications device of claim 1 wherein said at least one beam shaping element is positioned substantially parallel to a longitudinal axis of said housing.

8. The mobile wireless communications device of claim 1 further comprising wireless transceiver circuitry carried by said PCB and coupled to said antenna.

9. The mobile wireless communications device of claim 8 wherein said wireless transceiver circuitry comprises cellular transceiver circuitry.

10. The mobile wireless communications device of claim 1 wherein said at least one beam shaping element comprises a plurality thereof.

11. The mobile wireless communications device of claim 1 wherein said at least one beam shaping element and said antenna are not vertically overlapping.

12. A mobile wireless communications device comprising:

a housing having an interior and comprising a removable panel providing access to the interior;

a printed circuit board (PCB) carried by said housing and comprising opposing end portions;

an antenna connected to said PCB and carried by one of the opposing end portions of said PCB; and at least one electrically floating, electrically conductive, antenna beam shaping element secured to said removable panel.

13. The mobile wireless communications device of claim 12 wherein the opposing end portions comprise a bottom portion; and wherein said antenna is carried by the bottom portion.

14. The mobile wireless communications device of claim 12 further comprising an adhesive layer adhesively securing said at least one beam shaping element to said removable panel.

15. The mobile wireless communications device of claim 12 wherein said at least one beam shaping element comprises at least one generally rectangular metal layer.

16. The mobile wireless communications device of claim 12 further comprising a cover layer over said at least one beam shaping element.

17. The mobile wireless communications device of claim 12 wherein said removable panel comprises an exterior surface to which said at least one beam shaping element is secured.

18. The mobile wireless communications device of claim 12 wherein said removable panel comprises an interior surface to which said at least one beam shaping element is secured.

19. The mobile wireless communications device of claim 12 wherein said at least one beam shaping element is positioned substantially parallel to a longitudinal axis of said housing.

20. The mobile wireless communications device of claim 12 wherein said at least one beam shaping element comprises a plurality thereof.

21. The mobile wireless communications device of claim 12 wherein said at least one beam shaping element and said antenna are not vertically overlapping.

22. A method for reducing SAR of a mobile wireless communications device comprising a housing having an interior and comprising a removable panel providing access to the interior, a printed circuit board (PCB) carried by the housing and comprising opposing end portions, an antenna connected to the PCB and carried by one of the opposing end portions of the PCB, the method comprising:

securing at least one electrically floating, electrically conductive, antenna beam shaping element to the removable panel.

23. The method of claim 22 wherein the opposing end portions comprise a bottom portion; and wherein the antenna is carried by the bottom portion.

24. The method of claim 22 wherein securing comprises adhesively securing the at least one beam shaping element to the removable panel.

25. The method of claim 22 wherein the at least one beam shaping element comprises at least one generally rectangular metal layer.

26. The method of claim 22 further comprising applying a cover layer over the at least one beam shaping element.

27. The method of claim 22 wherein the removable panel comprises an exterior surface; and wherein securing comprises securing the at least one beam shaping element to the exterior surface.

28. The method of claim 22 wherein the removable panel comprises an interior surface; and wherein securing comprises securing the at least one beam shaping element to the interior surface.

29. The method of claim 22 wherein securing comprises securing the at least one beam shaping element to be positioned substantially parallel to a longitudinal axis of the housing.

30. The method of claim 22 wherein the at least one beam shaping element comprises a plurality thereof.

31. The method of claim 22 wherein securing comprises securing the at least one beam shaping element so as not to be vertically overlapping the antenna.

* * * * *